US011559878B2

(12) United States Patent
Weinberger et al.

(10) Patent No.: US 11,559,878 B2
(45) Date of Patent: Jan. 24, 2023

(54) MULTI-USE TOOL

(71) Applicant: MIW Associates LLC, Havertown, PA (US)

(72) Inventors: Marvin Weinberger, Havertown, PA (US); Adam Michael Hecht, Wyckoff, NJ (US)

(73) Assignee: MIW Associates LLC, Havertown, PA (US)

( * ) Notice: Subject to any disclaimer, the term of this patent is extended or adjusted under 35 U.S.C. 154(b) by 688 days.

(21) Appl. No.: 16/517,102

(22) Filed: Jul. 19, 2019

(65) Prior Publication Data

US 2020/0023504 A1 Jan. 23, 2020

Related U.S. Application Data

(60) Provisional application No. 62/700,954, filed on Jul. 20, 2018.

(51) Int. Cl.

| | |
|---|---|
| ***B25F 1/04*** | (2006.01) |
| ***B25F 1/00*** | (2006.01) |
| ***B25G 1/10*** | (2006.01) |
| ***B25D 1/00*** | (2006.01) |
| ***B27B 21/02*** | (2006.01) |

(52) U.S. Cl.

CPC ..... *B25F 1/04* (2013.01); *B25D 1/00* (2013.01); *B25F 1/006* (2013.01); *B25G 1/10* (2013.01); *B27B 21/02* (2013.01)

(58) Field of Classification Search

None

See application file for complete search history.

(56) References Cited

U.S. PATENT DOCUMENTS

| | | | | |
|---|---|---|---|---|
| 5,347,718 | A * | 9/1994 | Turner | A22B 3/10 30/122 |
| 7,472,484 | B2 * | 1/2009 | Smilanich | B25F 1/00 30/308.1 |
| 2013/0283540 | A1 * | 10/2013 | McDonough | B25F 1/02 7/144 |
| 2016/0354909 | A1 * | 12/2016 | Weinberger | B26B 11/00 |

* cited by examiner

*Primary Examiner* — Brian D Keller

(74) *Attorney, Agent, or Firm* — Duane Morris LLP

(57) ABSTRACT

A tool includes a handle and a blade. The handle extends from a handle first end to a handle second end. The blade has a first surface and an opposed second surface and defines a cutting edge between the first surface and the second surface. The blade extends from a blade first end to a blade second end. The blade and the handle are rotatably coupled at the blade first end and the handle first end about an axis extending from the first surface of the blade to the second surface of the blade. The blade is rotatable from a first position to a second position. The blade is lockable in the first position. When in the first position, the blade extends out from the handle second end.

15 Claims, 15 Drawing Sheets

MULTI-USE TOOL

CROSS REFERENCE TO RELATED APPLICATIONS

This application claims priority to U.S. Provisional Patent App. No. 62/700,954, filed on Jul. 20, 2018, the entirety of which is incorporated herein by reference.

BACKGROUND

Various tools are known for clearing brush and trimming trees, bushes, and other objects. One such tool is a machete. Machetes typically include a broad blade and a handle and are used to clear undergrowth. Shears are another common tool used for cutting objects. Shears include cutting blades that are operated in a scissor-like fashion to cut branches or stems. Additionally, removable and/or disposable saw blades are known for cutting various materials.

SUMMARY

A tool includes a handle and a blade. The handle extends from a handle first end to a handle second end. The blade has a first surface and an opposed second surface and defines a cutting edge between the first surface and the second surface. The blade extends from a blade first end to a blade second end. The blade and the handle are rotatably coupled at the blade first end and the handle first end about an axis extending from the first surface of the blade to the second surface of the blade. The blade is rotatable from a first position to a second position. The blade is lockable in the first position. When in the first position, the blade extends out from the handle second end.

In another aspect, a system includes a tool, a saw blade, and a sheath. The tool includes a handle and a blade. The handle extends from a handle first end to a handle second end. The blade has a first surface and an opposed second surface and defines a cutting edge between the first surface and the second surface. The blade extends from a blade first end to a blade second end. The blade and the handle are rotatably coupled at the blade first end and the handle first end about an axis extending from the first surface to the second surface of the blade. The blade is rotatable from a first position to a second position. The saw blade extends from a first end to a second end. The sheath is configured to receive a portion of the blade. The sheath defines a groove. When the blade is in the second position, the handle is configured to engage the first end of the saw blade and the groove of the sheath is configured to receive the second end of the saw blade.

In another aspect, a system includes a device including a first component, a second component, and a pin. The first component extends from a first end to a second end. The second component extends from a first end to a second end. The pin is coupled to the first component adjacent to the second end of the first component. The first component and the second component are rotatably coupled at the respective first ends of the first and second components. The second component is rotatable from a first position to a second position. When the second component is in the second position, the pin is configured to retain a first end of a saw blade.

BRIEF DESCRIPTION OF THE DRAWINGS

The features and advantages of the embodiments described herein will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
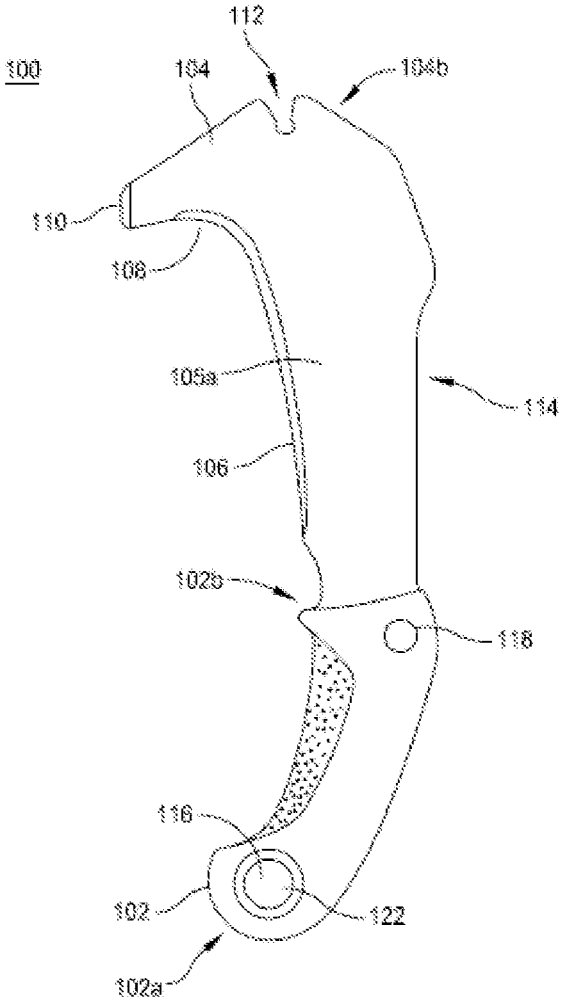
FIG. 1 shows a front view of a multi-use tool according to one embodiment, in a first configuration.

This description of the preferred embodiments is intended to be read in connection with the accompanying drawings, which are to be considered part of the entire written description. The drawing figures are not necessarily to scale and certain features may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship.

In a first aspect, the present disclosure provides a multi-use tool that is capable of transitioning from a first configuration, in which it can be used as a cutting blade (similar to a machete), to a second configuration, in which it can be used as shears. In another aspect, the multi-use tools described herein are configured to allow a saw blade to be removably attached to the tool such that the tool can be used as a saw to cut objects. The multi-use tools described herein can be used in a variety of settings and applications. For example, they are particularly useful for outdoor use and can be carried by hikers or campers to allow for multiple functions in one compact tool.

As shown in FIG. 1, in various embodiments, a multi-use tool 100 includes a handle 102 and a blade 104. As will be described in more detail herein, the blade 104 is rotatably mounted to the handle 102 such that the multi-use tool 100 can transition from a first configuration, shown in FIG. 1, to a second configuration, shown in FIG. 2. The handle 102 extends from a first end 102*a* to a second end 102*b* and can be configured to be ergonomically grasped by a user. The blade 104 extends from a first end 104*a* (shown in FIG. 2) to a second end 104*b* and has a first surface 105*a* and an opposed second surface 105*b* (shown in FIG. 5B). The handle 102 and blade 104 can each be constructed of any appropriate material. In one embodiment, both the handle 102 and blade 104 are constructed at least partially of steel.

Figure 4:
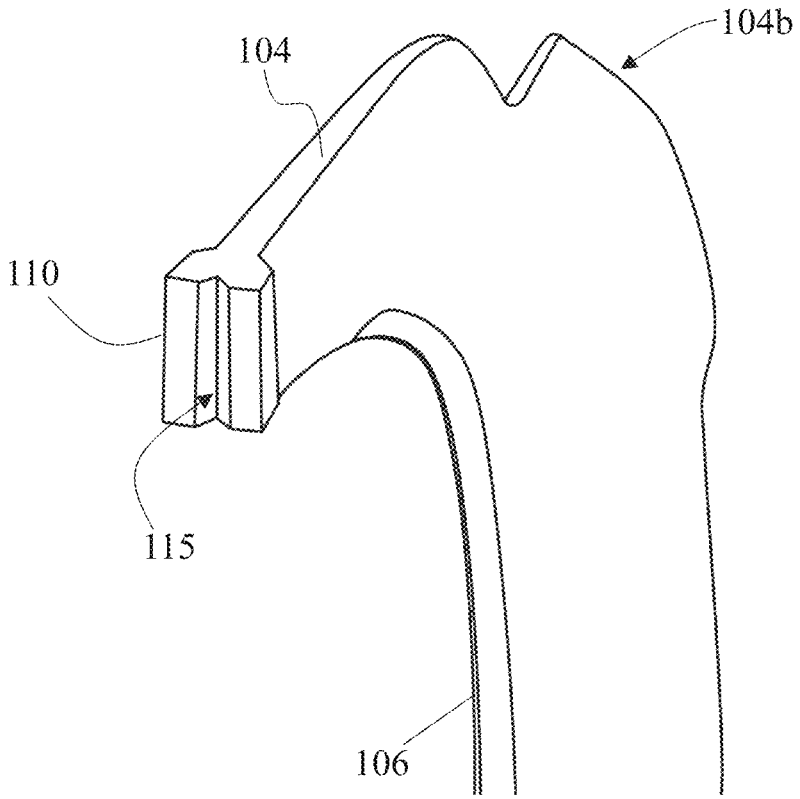
FIG. 4 shows a detail view of the hammer head of the multi-use tool of FIG. 1.
Figure 5A:
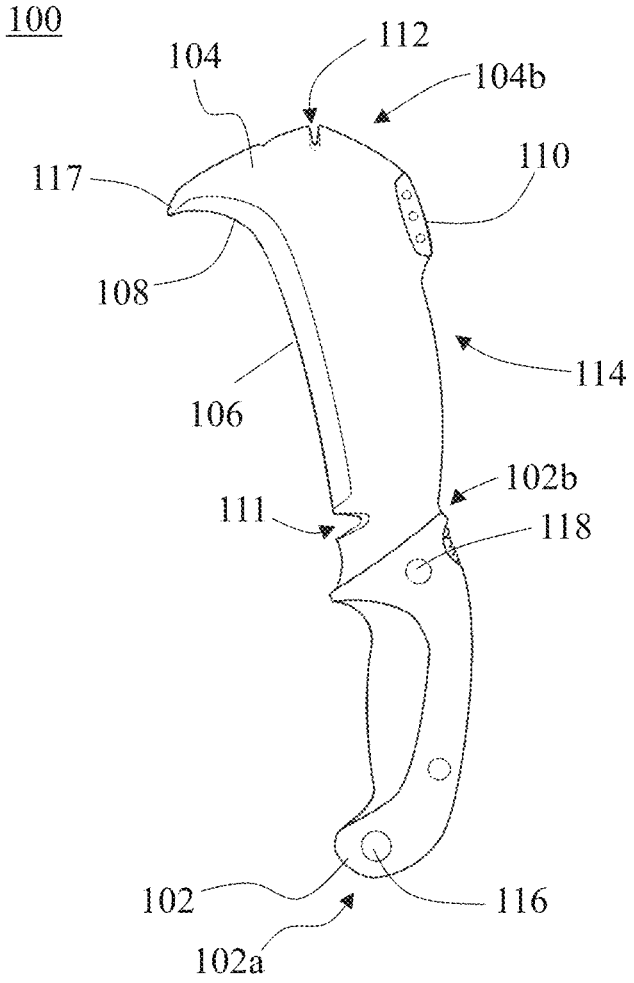
FIG. 5A shows a front view of a multi-use tool according to another embodiment in a first configuration.
Figure 5B:
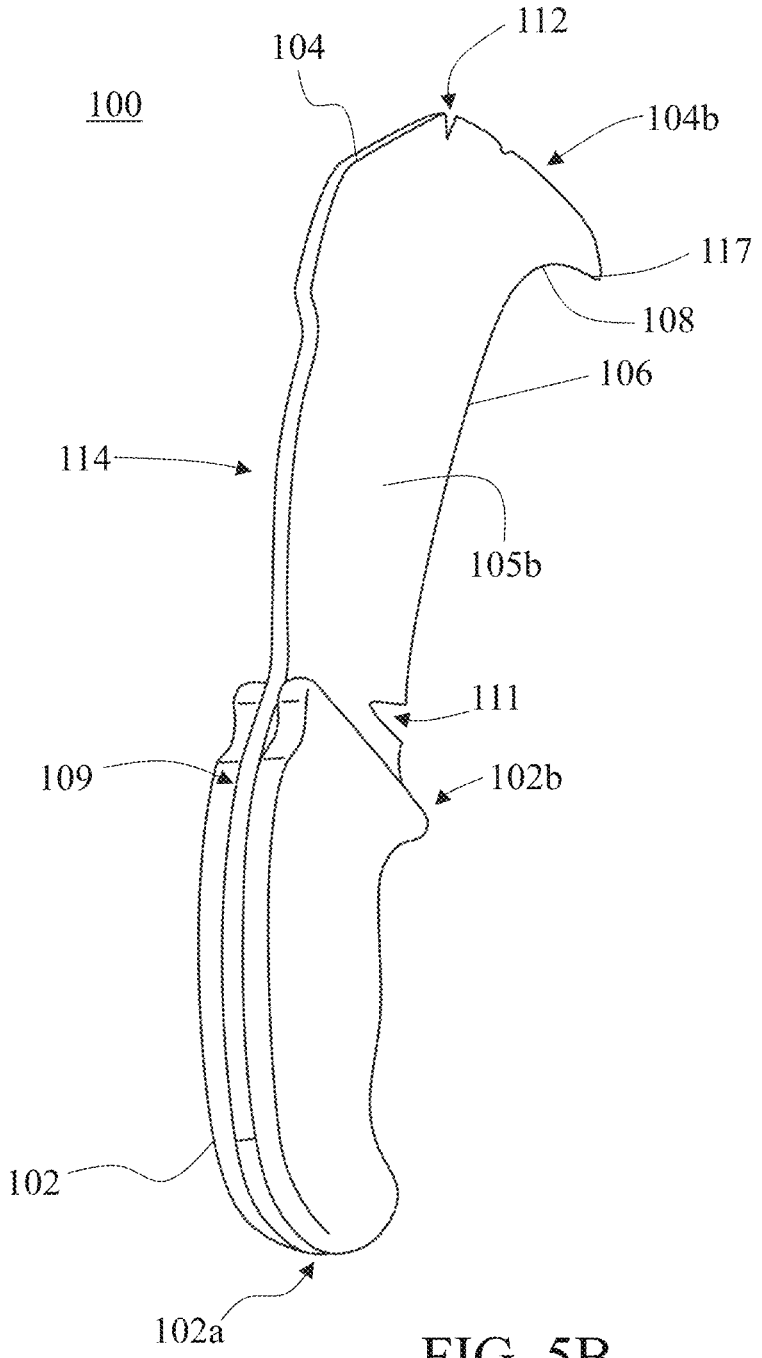
FIG. 5B shows a perspective view of the multi-use tool of FIG. 5A.

In the first configuration, the multi-use tool 100 can be used as a machete. A cutting edge 106 is defined between the first surface 105*a* and the second surface 105*b* of the blade 104 for cutting limbs, brush, and other objects. The cutting edge 106 can be located at any desired position on the blade 104. In one embodiment, the blade can include a hooked or concave portion 108 that is configured to assist with clearing brush. The sharpened portion of the cutting edge 106 can extend at least partially into the concave portion 108 to allow for cutting of brush. In another embodiment, the cutting edge 106 is on the opposite side of the blade 104 from the concave portion 108. In such an embodiment, the concave portion 108 can include a second cutting edge on its interior, concave portion to cut debris. The blade 104 can further include a relatively flat face 110 configured to be used as a hammer to drive nails, tent or peg stakes, or other objects. The face 110 can be at the tip of the concave portion 108 or, alternatively, can be at any other portion of the blade 104 (such as at a side opposite the cutting edge 106 as shown in FIG. 5A). The face 110 can be thicker than other portions of the blade 104, as shown in FIG. 4, to provide a relatively large surface for driving nails and tent stakes. In addition, the face 110 may be formed by an insert that is coupled to the blade 104 such that the face 110 is harder or otherwise more robust than the rest of the blade 104. The blade 104 can further include a recess 112 configured to be used as a nail puller. A portion of the blade 104 (e.g., adjacent to recess 112) may be configured to form a pry or spade. In at least one embodiment, the blade 104 further includes a hand hold portion 114. The hand hold portion 114 can include a concave region configured for comfortably receiving a user's hand, as will be described further herein.

The blade 104 is rotatably mounted to the handle 102 via a pivot 116 about an axis 107 (shown in FIG. 9) at the respective first ends of the handle 102 and the blade 104. The blade is configured to rotate about the pivot 116 from the first configuration to the second configuration. In the first position, the blade 104 extends from the second end 102*b* of the handle 102. The handle 102 may include a slot 109 (shown in FIGS. 5B and 9) extending from the first end 102*a* to the second end 102*b* and, when in the first position, the blade 104 is at least partially disposed in the slot 109. The blade 104 can be locked in the first configuration. For example, the multi-use tool 100 can include a pin 118 coupled to the handle 102. The pin 118 is configured to engage an aperture 120 (shown in FIG. 2) in the blade 104 to retain the blade 104 in position. In one embodiment, the pin 118 is spring loaded such that it automatically engages the blade 104 when the blade is rotated to the first configuration.

In some embodiments, the blade 104 can be released to rotate by depressing a button 122. In such embodiments, depression of the button 122 releases the pin 118, or otherwise releases the blade such that it can rotate with respect to the handle 102, and allows the blade 104 to rotate.

Figure 2:
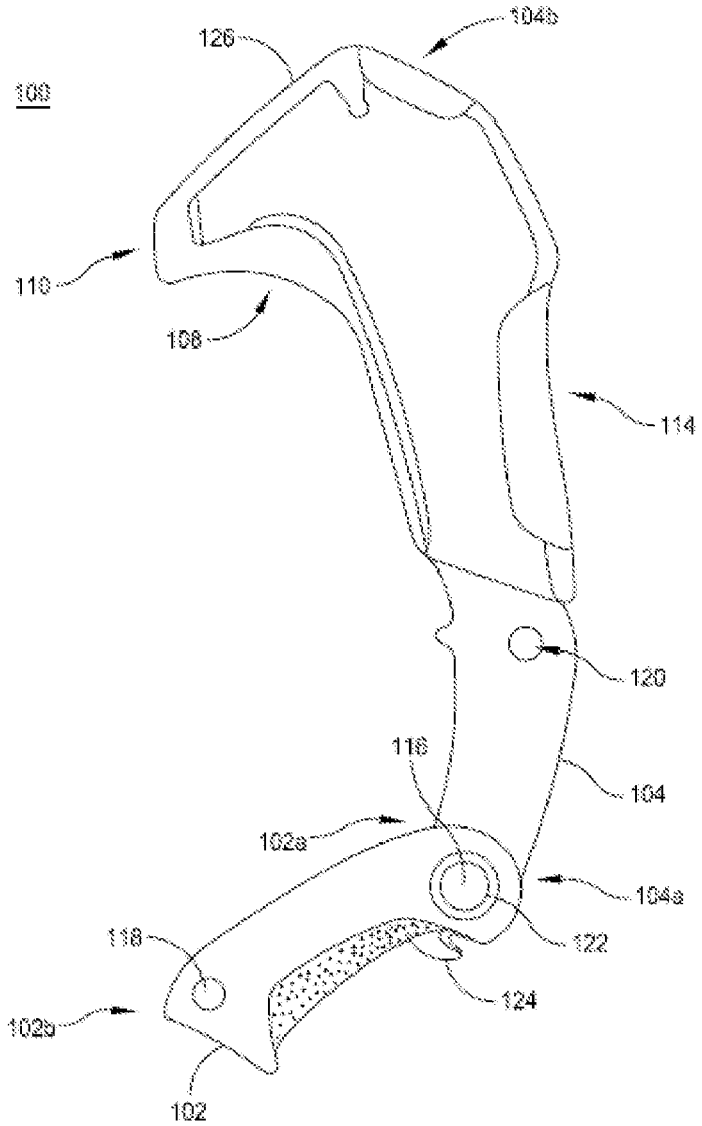
FIG. 2 shows a front view of the multi-use tool of FIG. 1, in a second configuration.

As shown in FIG. 2, with the blade in the second configuration, a jaw 124 extending from the first end 104*a* of the blade 104 is exposed adjacent the pivot 116. The jaw 124 has a sharpened edge such that it can be used, in conjunction with the portion of the handle 102 adjacent the pivot 116, as a shear. The jaw 124 and the handle 102 define a space between them and rotation of the blade 104 toward the first position reduces the space between the jaw 124 and handle 102 to cut objects positioned therein. Hence, the jaw 124 can be used to cut nails and other objects that are placed between the jaw 124 and the handle 102. The blade 104 and the handle 102 can be used in a scissoring motion to operate the shear.

As shown in FIG. 2, a sheath 126 can be placed over at least a portion of the blade 104 to protect the user's hand from the cutting edge 106. The sheath 126 can be retained in place on the blade 104 through any appropriate means. In one embodiment, hook and loop fastener is used to retain the sheath 126 in place. With the sheath 126 in place, the user can grasp the blade 104 at hand hold portion 114. The sheath 126 can be constructed of any appropriate material, such as, for example, leather.

Figure 3:
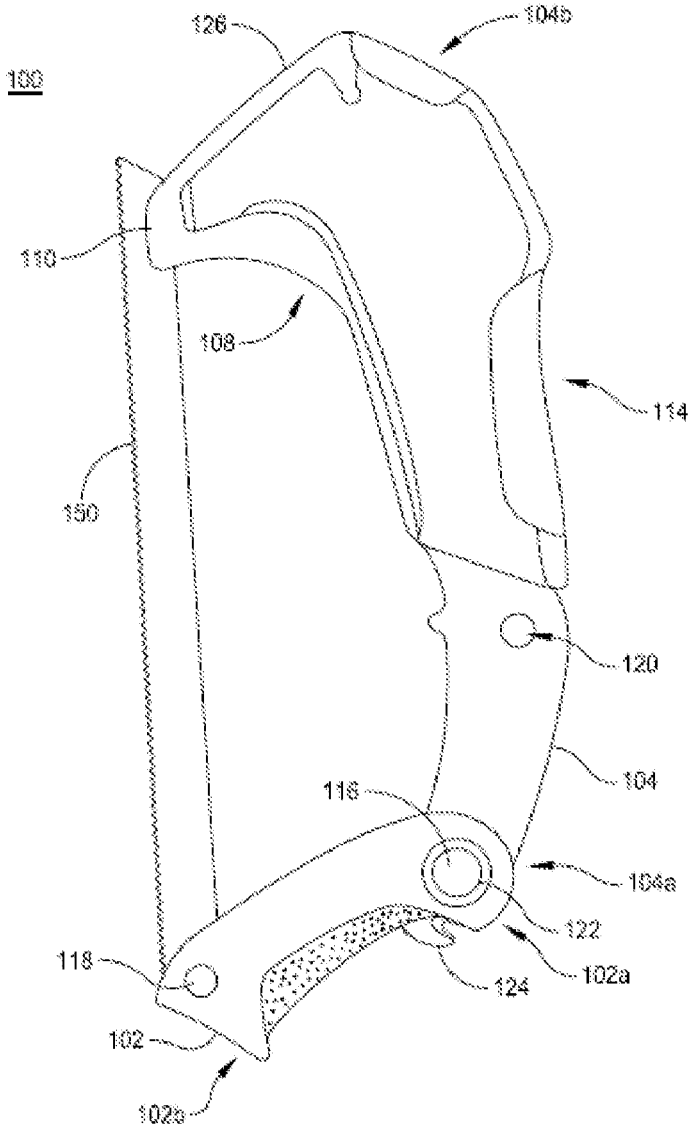
FIG. 3 shows a front view of a system including the multi-use tool of FIG. 1 and a saw blade.
Figure 8:
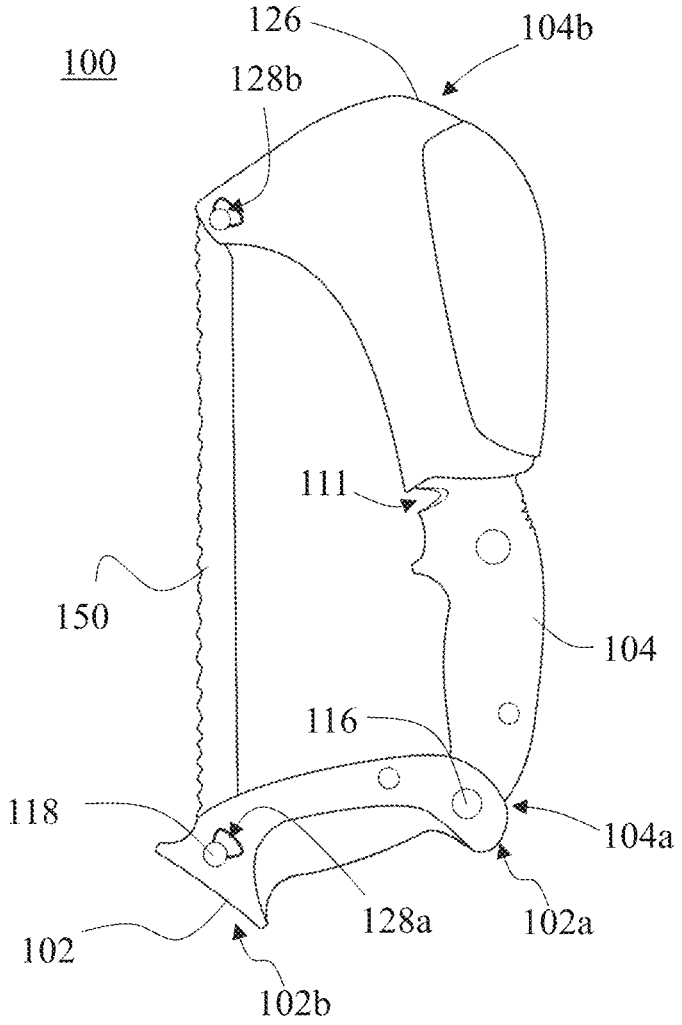
FIG. 8 shows a front view of a system including the multi-use tool of FIG. 5A and a saw blade.

Further, as shown in FIG. 3, with the blade 104 in the second position, the multi-use tool 100 can be used as a saw by removably attaching a saw blade 150 to the multi-use tool 100. A first end of the saw blade 150 can be attached to the handle 102 (e.g., the second end 102*b* of the handle 102). The saw blade 150 can be attached by any appropriate means. For example, the pin 118 can engage the first end of the saw blade 150. The second end of the saw blade 150 can be disposed in a groove 113 in the sheath 126 (shown in FIG. 10). Alternatively, or additionally, the blade 104 can include a groove 115 for retaining the saw blade 150 (shown in FIG. 4). For example, the face 110 can include the groove 115. In one embodiment, the groove 115 can also be used as a nail claw. In one embodiment, the saw blade 150 includes one or more holes at each end thereof to allow for connection to the handle 102 at one end and to the sheath 126 or face 110 at the opposite end. In some embodiments, the multi-use tool 100 includes pins or screws to secure the saw blade 150 to the multi-use tool 100. For example, in some embodiments, the pin 118 that secures the blade 104 in the first configuration is also used to secure the saw blade 150 to the handle 102. Using the saw blade 150 as shown in FIG. 3 (or as shown in FIG. 8 and described below) may also allow the use of two hands during operation, with one hand on handle 102 and one hand on hand hold portion 114.

The saw blade 150 can be any appropriate blade and be suitable for cutting a desired material. The saw blade 150 can be configured to cut wood, steel, aluminum, plastic, or any other desired material. For example, the saw blade 150 can be a SAWZALL® blade distributed by Milwaukee Tool of Brookfield, Wis. Alternatively, the saw blade can be a pruning saw blade such as the BARRACUDA™ blade sold by Jameson LLC of Clover, S.C. Alternatively, the saw blade can be a bow saw blade such as that sold by Great Neck Saw Manufacturing, Inc. of Mineola, N.Y. Alternatively, the saw blade 150 can be a hacksaw style blade.

In one embodiment, the blade 104 is configured to lock in various angular positions such that saw blades of various lengths can be accommodated by the multi-use tool 100. A locking mechanism can be used to lock the blade 104 in the desired position.

FIGS. 5A-11 show another embodiment of the multi-use tool 100. FIGS. 5A and 5B shows the multi-use tool 100 in its first configuration, in which it can be used as a machete. As can be seen in FIG. 5B, when in the first configuration, a portion of the blade 104 is disposed in the slot 109 of the handle 102. Further, in this embodiment, the blade 104 includes a tip 117 that may be relatively pointed such that it can be used to pull tent stakes from the ground. Additionally, in this embodiment, the flat face 110 is on a side of the blade 104 opposite the cutting edge 106.

Figure 6A:
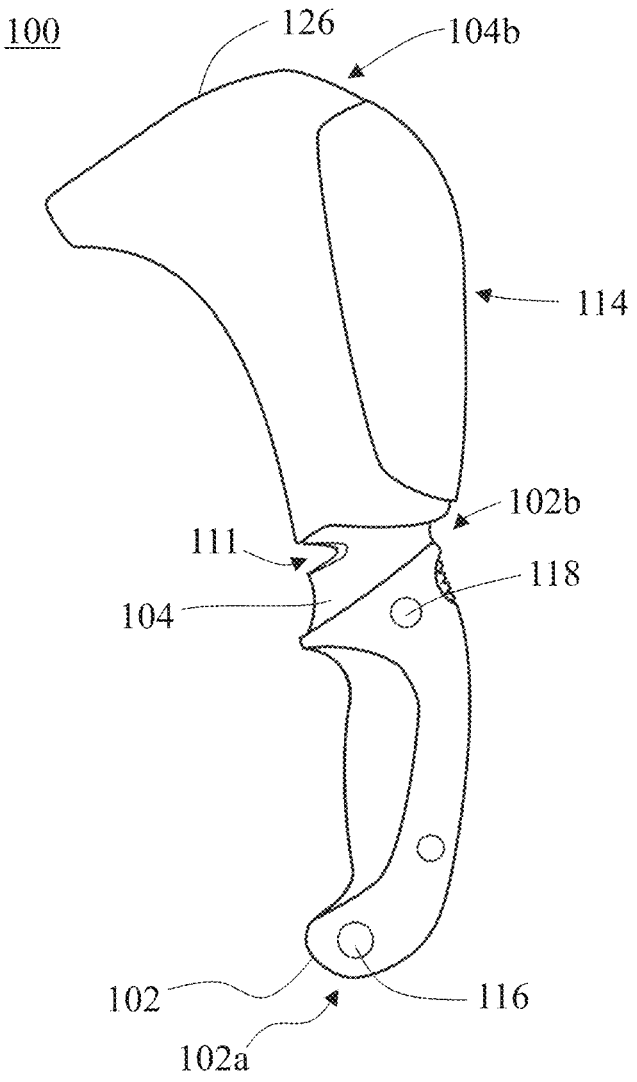
FIG. 6A shows a front view of the multi-use tool of FIG. 5A with a sheath coupled to the blade.
Figure 6B:
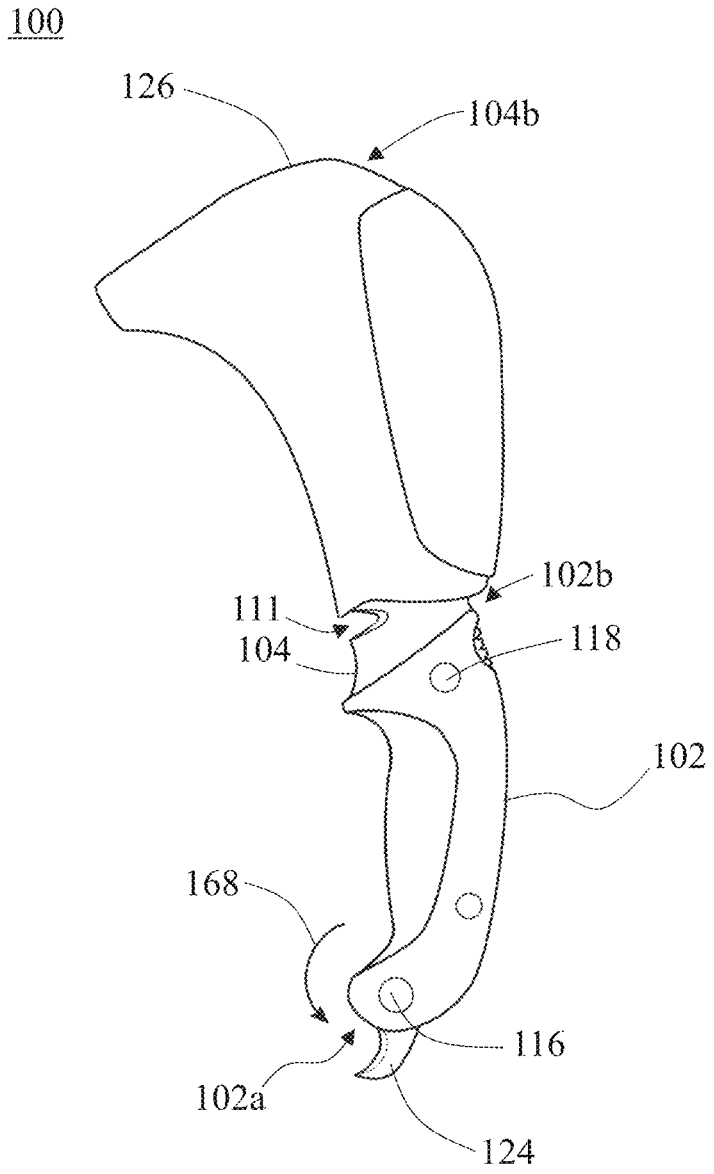
FIG. 6B shows a front view of the multi-use tool of FIG. 5A with the jaw deployed.

FIGS. 6A and 6B show front views of the multi-use tool 100 in the first configuration and with the sheath 126 engaged with the blade 104. In this embodiment, as shown in FIG. 6B, the jaw 124 extends from the first end 102*a* of the handle 102. In this position, the sharp edge of the jaw 124 can be used as a gutting blade. In some embodiments, the jaw 124 is fixed in this position. In other embodiments, the jaw 124 is rotatable as illustrated by arrow 168. In such embodiments, the jaw 124 may be rotated to a position in which it is housed within the handle 102 (as shown in FIG. 6A).

Figure 7:
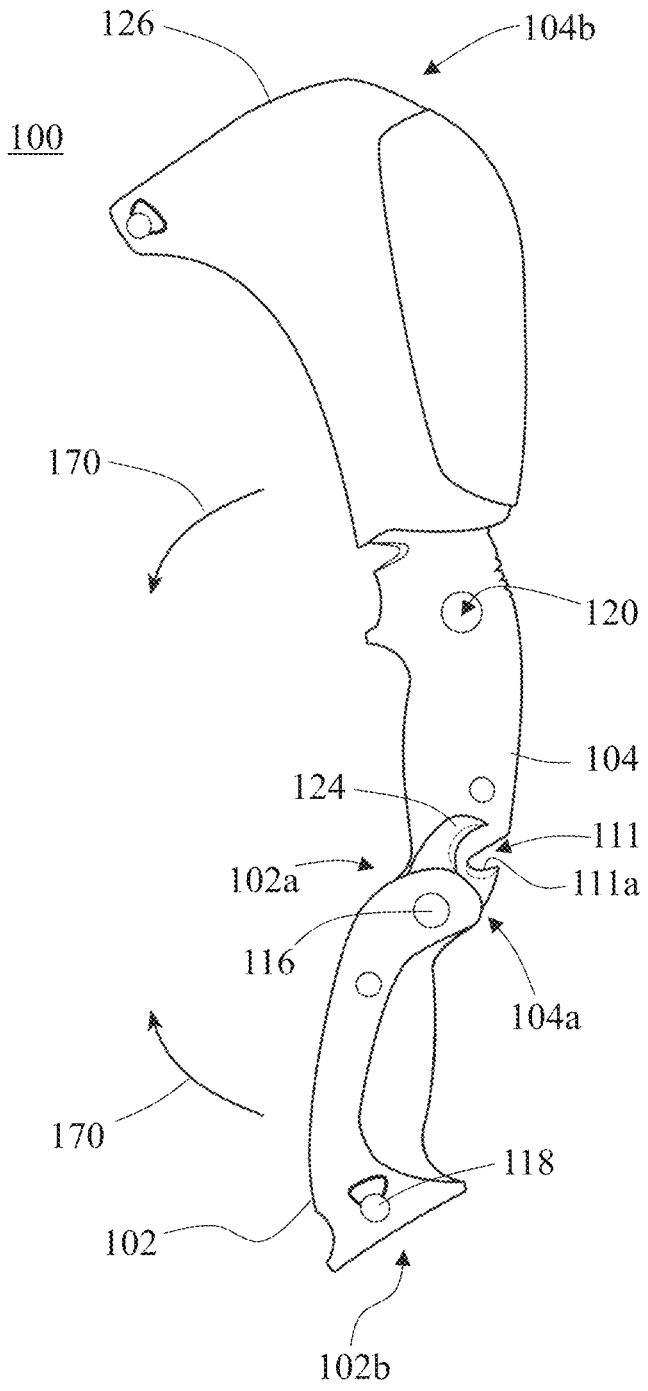
FIG. 7 shows a front view of the multi-use tool of FIG. 5A in a second configuration.

FIG. 7 shows the multi-use tool 100 in the second configuration such that the handle 102 and blade 104 can be used in a scissor-like motion to cut objects, as described above, by moving the handle 102 and blade 104 toward each other as illustrated by the arrows 170. In this embodiment, the jaw 124 forms the top portion of the shear. The blade 104 includes a notch 111 with a sharpened edge 111*a* that forms the bottom portion of the shear. Rotation of the blade 104 toward the first position reduces the space between the jaw 124 and the sharpened edge 111*a*, to cut objects disposed therein. When in the first configuration, the notch 111 and sharpened edge 111*a*, can be used as a rope or cord cutter by pulling the rope, cord, or other object tight against the sharpened edge 111*a*.

FIG. 8 shows the multi-use tool 100 connected to a saw blade 150, as described above with respect to FIG. 3. In this position, the multi-use tool 100 can be used to cut objects, as described above. The handle 102 and the sheath 126 can each include apertures 128*a* and 128*b*, respectively, configured to allow for engagement of the saw blade 150. In some embodiments, the saw blade 150 can include pins and the apertures 128*a*, 128*b* can be configured to receive the pins to removably engage the saw blade. In other embodiments, the multi-use tool 100 may include pins (e.g., pin 118) disposed in apertures 128*a*, 128*b* and coupled to the handle 102 and the blade 104, respectively. In such embodiments, the pins are configured to engage apertures in the saw blade 150 to retain the saw blade 150 in place. The pins may be, for example, threaded pins—such as screws—or may be unthreaded pins. In various embodiments, one or both of the pins may be set screws configured to press against the saw blade 150 to retain the saw blade in the slot 109 or the groove 113 in the sheath 126. In another embodiment, a screw extends through an unthreaded hole in the sheath 126 on one side of the groove 113 and is threadably engaged with a hole in the sheath 126 on the other side of the groove 113. In such embodiments, rotation of the screw pulls the walls defining the groove 113 together, thereby engaging the saw blade 150 to frictionally retain it.

In other embodiments, the saw blade 150 is not positively retained in the groove 113 or groove 115. In other words, a pin or screw is not used to lock the saw blade 150 to the sheath 126 or to the blade 104. Instead, the grooves 113, 115 are simply configured to retain and stabilize the saw blade 150 during operation.

Figure 9:
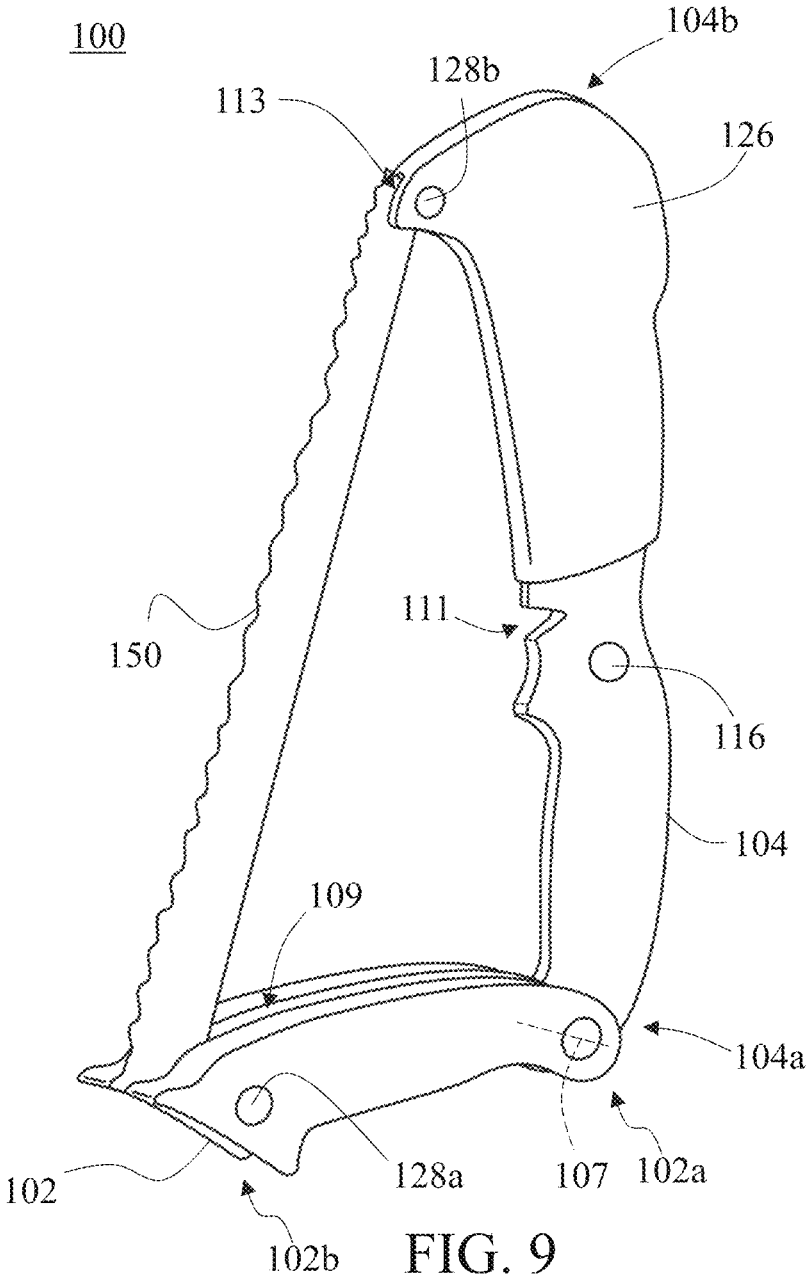
FIG. 9 shows a perspective view of the system of FIG. 8.
Figure 10:
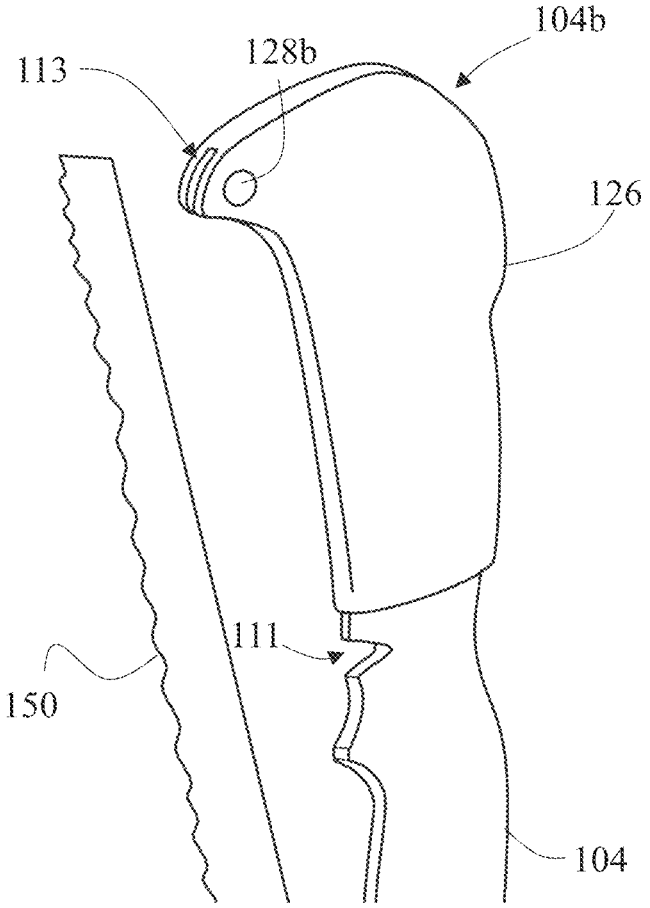
FIG. 10 shows a partial perspective view of the system of FIG. 8 before connection of the saw blade to the sheath.

FIG. 9 shows a perspective view of the multi-use tool 100 in the second configuration. As shown, the blade 104 is rotated about axis 107 out of the slot 109 in the handle 102. The saw blade 150 is engaged with the second end 102*b* of the handle 102 and with the groove 113 in the sheath 126. FIG. 10 shows the sheath 126 and saw blade 150 prior to insertion of the saw blade 150 into the groove 113. In some embodiments, a portion of the sheath 126 defining the groove 113 is constructed of a relatively rigid and/or durable material to securely engage the saw blade 150. For example, the portion of the sheath 126 defining the groove may be constructed from steel, stainless steel, aluminum, or iron.

Figure 11:
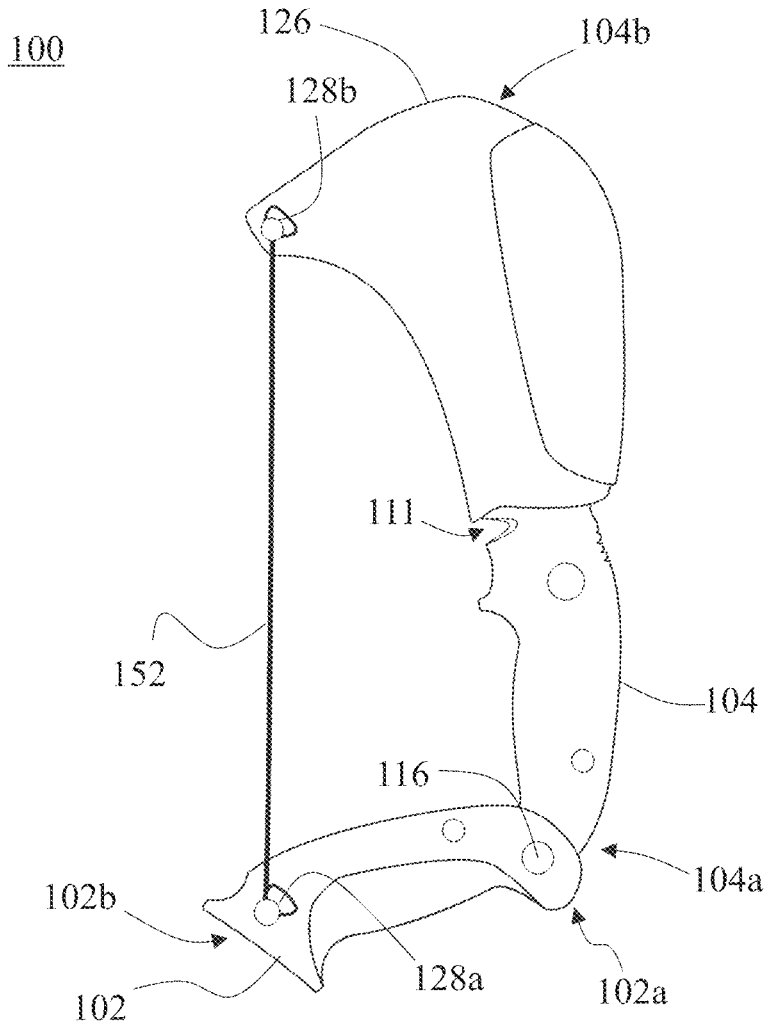
FIG. 11 shows a front view of a system including the multi-use tool of FIG. 5A and a wire or rope saw.

Further, as shown in FIG. 11, the multi-use tool 100 can be configured to engage a wire or rope saw 152. The wire or rope saw 152 can then be used to cut objects, such as branches. The wire or rope saw 152 can be any appropriate saw, including the Pocket Saws or Camping Saws sold by Bestway Products Company of Gardena, Calif. One end of the wire or rope saw 152 can be connected to the handle 102. The opposite end of the wire or rope saw 152 can be connected to the sheath 126 or the blade 104. In one embodiment, the second end of the wire or rope saw 152 connects to both the sheath 126 and blade 104 to provide a more secure retention. The multi-use tool 100 can further include a tensioning mechanism to tension the wire or rope saw 152. The tensioning mechanism may include, for example, a torsion screw and/or a ratcheting mechanism to tension the wire or rope saw 152 and then to maintain the tension.

Figure 12:
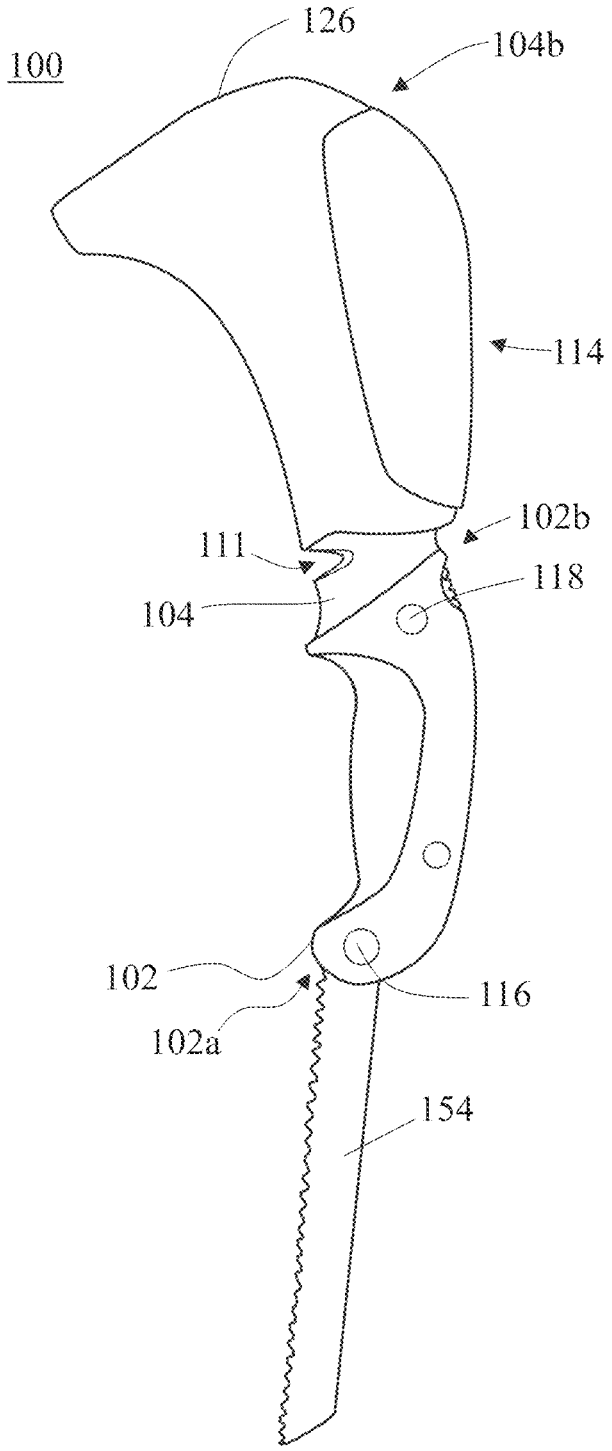
FIG. 12 shows a front view of a system including the multi-use tool of FIG. 5A and a saw blade.

FIG. 12 shows the multi-use tool 100 engaged with a saw blade 154 that extends from the first end 102*a* of the handle 102. The saw blade 154 can be any appropriate saw blade, including those described above. Engaging the saw blade 154 as shown in FIG. 12 may allow it to be used in areas or applications that would be difficult to reach or access with the configuration shown in FIGS. 3 and 8. Using the saw blade 154 as shown in FIG. 12 may also allow the use of two hands during operation, with one hand on handle 102 and one hand on hand hold portion 114. This may allow more force to be applied during operation. The saw blade 154 can be engaged with the multi-use tool 100 in any appropriate manner, including pins, clamping, or using any other appropriate technique.

Figure 13:
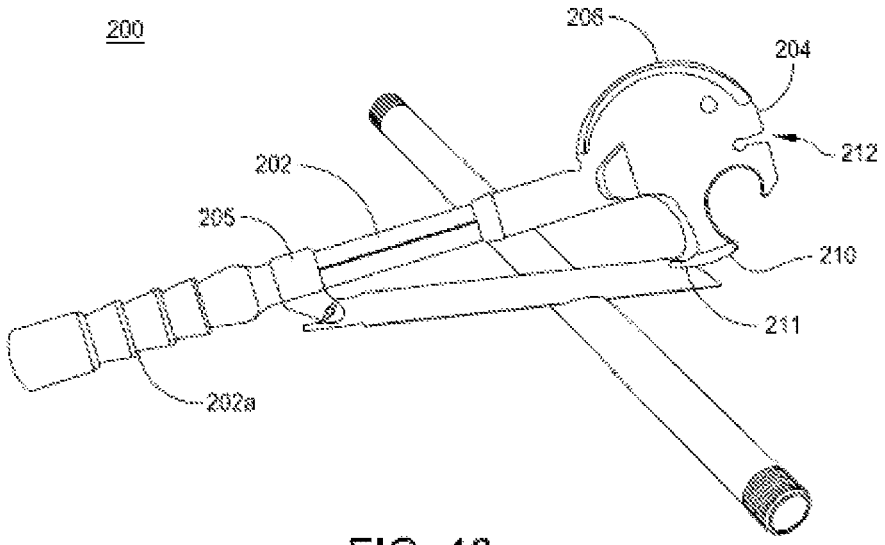
FIG. 13 shows a perspective view of a multi-use tool, according to another embodiment.

In various embodiments, as shown in FIG. 13, another multi-use tool 200 is provided. The multi-use tool 200 includes a handle 202, a head 204, and a saw blade retainer 205. The handle 202 can include a grip 202*a*.

The head 204 can include a variety of tools for performing a variety of functions. For example, the head 204 can include a sharpened edge 206. The head can also include a hammer head 210 and a nail claw 211. The head 204 can also include a recess 212 that can be used as a pry or spade, as described above with respect to recess 112 of multi-use tool 200. Additionally, the head can include a spanner wrench, a tire chain hook, and a nail puller.

The saw blade retainer 205 is configured to retain a first end of a saw blade 150. For example, the saw blade retainer 205 can be in the form of a clamp configured to be tightened on the end of the saw blade 150 and, optionally, engage an aperture in the saw blade 150.

The saw blade is retained by the head 204. The head 204 includes a groove to receive the saw blade 150. The groove can be formed in the hammer head 210 or the nail claw 211.

In at least one embodiment, the saw blade retainer 205 is slidable along the length of the handle 202 to adjust the distance between the saw blade retainer 205 and the head 204. Hence, saw blades of various lengths can be accommodated. Adjusting the position of the saw blade retainer can also adjust the angle of the saw blade. This may allow the saw blade to be positioned at a more comfortable angle or provide additional clearance for the object being cut. In addition, the saw blade can be configured to extend beyond the head 204 such that the span of the saw blade between the saw blade retainer 205 and the head 204 or the span extending beyond the head 204 can be used for cutting.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention. All patents and published patent applications identified herein are incorporated herein by reference in their entireties.

We claim:

1. A tool, comprising:

a handle extending from a handle first end to a handle second end;

a blade including a first surface and an opposed second surface and defining a cutting edge between the first surface and the second surface, the blade extending from a blade first end to a blade second end; and a pin coupled to the handle adjacent to the handle second end and to an aperture in the blade to lock the handle and the blade in a first position, wherein the blade and the handle are rotatably coupled at the blade first end and the handle first end to pivot about an axis extending through the handle and from the first surface of the blade to the second surface of the blade;

the blade is rotatable from the first position to a second position;

the blade is lockable in the first position; and when in the first position, the blade extends out from the handle second end;

wherein the cutting edge includes a concave portion, and wherein the blade includes a face configured to be used as a hammer head extending between the first surface and the second surface at a termination of the concave portion of the cutting edge, and wherein the face defines a groove configured to retain a saw blade.

2. The tool of claim 1, wherein the handle defines a slot extending between the handle first end and the handle second end, and wherein, when in the first position, the blade is partially disposed in the slot.

3. The tool of claim 1, wherein the blade includes a jaw adjacent the blade first end, wherein the jaw includes a second cutting edge defined between the first surface and the second surface, and wherein, when the blade is in the second position, the jaw and the handle define a space therebetween, and wherein rotation of the blade toward the first position reduces the space to cut an object positioned within the space.

4. The tool of claim 1, further comprising a jaw coupled to and extending from the handle first end, wherein the blade includes a notch configured to receive an object, and wherein, with the blade in the second position, rotation of the blade toward the first position causes the jaw to cut the object disposed in the notch.

5. The tool of claim 1, wherein the pin is further configured to engage an aperture in a saw blade.

6. A system, comprising:

a tool, including:

a handle extending from a handle first end to a handle second end;

a blade having a first surface and an opposed second surface and defining a cutting edge between the first surface and the second surface, the blade extending from a blade first end to a blade second end; and a pin coupled to the handle adjacent to the handle second end and to an aperture in the blade to lock the handle and the blade in a first position, wherein the blade and the handle are rotatably coupled at the blade first end and the handle first end to pivot about an axis extending through the handle and from the first surface to the second surface of the blade; and the blade is rotatable from the first position to a second position;

a saw blade extending from a first end to a second end; and a sheath configured to receive a portion of the blade, wherein the sheath defines a groove;

when the blade is in the second position, the handle is configured to engage the first end of the saw blade and the groove of the sheath is configured to receive the second end of the saw blade.

7. The system of claim 6, wherein the handle defines a slot extending between the handle first end and the handle second end, and wherein, when in the first position, the blade is partially disposed in the slot.

8. The system of claim 6, wherein the blade includes a jaw adjacent the blade first end, wherein the jaw includes a second cutting edge, and wherein, when the blade is in the second position, the jaw and the handle define a space therebetween, and wherein rotation of the blade toward the first position reduces the space to cut an object positioned within the space.

9. The system of claim 6, further comprising a jaw coupled to and extending from the handle first end, wherein the blade includes a notch configured to receive an object, and wherein, with the blade in the second position, rotation of the blade toward the first position causes the jaw to cut the object disposed in the notch.

10. The system of claim 6, wherein a portion of the sheath defining the groove is constructed of a material selected from the group consisting of: steel, stainless steel, aluminum, and iron.

11. A tool, comprising:

a handle extending from a handle first end to a handle second end;

a blade including a first surface and an opposed second surface and defining a cutting edge between the first surface and the second surface, the blade extending from a blade first end to a blade second end; and a pin coupled to the handle adjacent to the handle second end and to an aperture in the blade to lock the handle and the blade in a first position, wherein the blade and the handle are rotatably coupled at the blade first end and the handle first end to pivot about an axis extending through the handle and from the first surface of the blade to the second surface of the blade;

the blade is rotatable from the first position to a second position;

the blade is lockable in the first position; and when in the first position, the blade extends out from the handle second end;

wherein the blade includes a jaw adjacent the blade first end, wherein the jaw includes a second cutting edge defined between the first surface and the second surface, wherein, when the blade is in the second position, the jaw and the handle define a space therebetween, and wherein rotation of the blade toward the first position reduces the space to cut an object positioned within the space.

12. The tool of claim 11, further comprising a sheath configured to receive a portion of the blade, wherein the sheath includes a groove configured to receive the saw blade.

13. The tool of claim 12, wherein the sheath further includes a second pin configured to couple to a wire saw.

14. The tool of claim 12, wherein a portion of the sheath defining the groove is constructed of a material selected from the group consisting of: steel, stainless steel, aluminum, and iron.

15. The tool of claim 11, wherein the second end of the blade includes a hammer head defining a groove configured to receive a second end of the saw blade.

* * * * *